US008720578B2

(12) United States Patent
Allensworth et al.

(10) Patent No.: US 8,720,578 B2
(45) Date of Patent: May 13, 2014

(54) TELESCOPING ORIENTATION JOINT

(75) Inventors: David C. Allensworth, Pearland, TX (US); Josh Rayner, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 62 days.

(21) Appl. No.: 13/105,644

(22) Filed: May 11, 2011

(65) Prior Publication Data

US 2011/0278013 A1 Nov. 17, 2011

Related U.S. Application Data

(60) Provisional application No. 61/333,549, filed on May 11, 2010.

(51) Int. Cl.
*E21B 33/038* (2006.01)
*E21B 17/01* (2006.01)
*E21B 17/07* (2006.01)

(52) U.S. Cl.
USPC ..... 166/341; 166/344; 166/364; 166/368; 166/85.4; 166/85.5

(58) Field of Classification Search
USPC ..... 166/336, 338, 341, 350, 363, 364, 378, 166/381, 382, 85.4, 85.5
See application file for complete search history.

(56) References Cited

U.S. PATENT DOCUMENTS

| | | | | |
|---|---|---|---|---|
| RE27,464 | E * | 8/1972 | Taylor, Jr. | 166/363 |
| 4,030,354 | A * | 6/1977 | Scott | 73/152.01 |
| 4,196,781 | A | 4/1980 | Cheek | |
| 4,209,891 | A * | 7/1980 | Lamb et al. | 29/466 |
| 4,386,656 | A * | 6/1983 | Fisher et al. | 166/117.5 |
| 5,957,198 | A | 9/1999 | Haynes | |
| 5,975,210 | A * | 11/1999 | Wilkins et al. | 166/341 |
| 6,070,668 | A * | 6/2000 | Parks et al. | 166/345 |
| 6,231,265 | B1 * | 5/2001 | Rytlewski et al. | 403/322.1 |
| 2006/0042791 | A1 | 3/2006 | Hosie et al. | |

OTHER PUBLICATIONS

PCT/US2011/036147 Written Opinion and International Search Report.

* cited by examiner

*Primary Examiner* — James Sayre
(74) *Attorney, Agent, or Firm* — Jeffery R. Peterson; Brandon S. Clark

(57) ABSTRACT

An orientation joint for a subsea landing string equipped to maintain both unitary and telescoping configurations. For example, the joint may maintain a unitary configuration to provide continuous orientation definition while lowering a landing string within a blowout preventer (BOP). Additionally, the orientation joint may be configured to telescope and provide an appropriately sized uniform outer diameter surface to enable a sealing engagement with an aligned ram of the BOP.

12 Claims, 4 Drawing Sheets

TELESCOPING ORIENTATION JOINT

CROSS-REFERENCE TO RELATED APPLICATION

The present document is based on and claims priority to U.S. Provisional Application Ser. No. 61/333549, filed May 11, 2010.

FIELD

Embodiments described relate to landing strings for delivering a host of interventional and/or monitoring tools to a downhole location in a well. More specifically, embodiments of subsea landing strings are detailed which are configured for uniquely interfacing with blowout preventer equipment. Thus, well integrity and access may be enhanced.

BACKGROUND

Exploring, drilling and completing hydrocarbon and other wells are generally complicated, time consuming, and ultimately expensive endeavors. As a result, over the years, a significant amount of added emphasis has been placed on well monitoring and maintenance.

In terms of interventional monitoring and maintenance in subsea hydrocarbon operations, various tools and testing devices may be provided by way of a subsea landing string system. Such a system may enable completion, flow testing, intervention, and other subsea well operations to be performed from a floating vessel. Generally, the landing string is run down through a marine riser and access to the well is achieved through a BOP (blowout preventer). The BOP contains a number of features used to ensure well integrity, including any of several shearing and sealing rams, as well as some operation-specific features, such as orientation pins used to define the orientation of the landing string.

One of the more significant considerations in designing a subsea landing string is the space-out of the landing string within the BOP. The "space-out" refers to the location of various features of the landing string relative to the relevant features of the BOP, in particular shearing and sealing rams, as well as orientation pins and other features. It is important that the landing string be configured in such a way that the necessary BOP functionality (e.g., sealing) can be maintained.

With such landing string challenges as noted above, one feature that may be included, particularly when running well completions, is a Tubing Hanger Orientation Joint (THOJ). This is a section of the landing string that defines the rotational orientation of the landing string relative to the BOP in order to properly install or interface with the tubing hanger for vertical production trees. In many cases the THOJ achieves this orientation through the use of an orientation helix and a slot (keyway) or the like, which interact with a pin or key projecting into the BOP interior. Typically these orientation features gradually impose the correct orientation over some distance of vertical travel as the landing string is lowered into the BOP.

Unfortunately, the required distance of vertical travel to achieve proper orientation contributes to a minimum height requirement for the orientation joint. This in turn, may conflict with the desired BOP space-out for performing certain well operations. Addressing this conflict may potentially be achieved by performing the necessary operations in multiple runs, each with a different landing string configuration. However, the requirement of multiple runs and landing string change outs would be quite time-consuming, dramatically increasing the cost of operations.

SUMMARY

Embodiments of a Tubing Hanger Orientation Joint (THOJ) are disclosed. These embodiments are directed at the potential conflict between the long distance of vertical travel needed to define the orientation of the landing string, and the requirement of placing an appropriate sealing surface at a particular location within a blowout preventer (BOP). More specifically, a sealing interface is generally sought across the BOP sealing rams, most likely upon landing out or connecting to a tubing hanger. In such a case the necessary vertical height of the orientation feature (such as a helix of the joint) might result in this feature blocking a necessary BOP ram, rendering it ineffective. Thus, in order to avoid eliminating the sealing capacity of the ram, the THOJ is configured to telescope after landing. As such, a continuous orientation feature (such as a helix) for orienting the landing string may be available until proper landing is achieved. Thereafter, the joint may be split and telescoped to provide a sealing (or shearing) surface across the desired BOP rams, as may be required for subsequent operations.

DETAILED DESCRIPTION

Embodiments herein are described with reference to certain types of landing strings and blowout preventer equipment. For example, these embodiments focus on completion assemblies for subsea operations. However, a variety of alternative operations may take advantage of embodiments of a telescoping joint for a landing string as detailed herein.

Figure 1A:
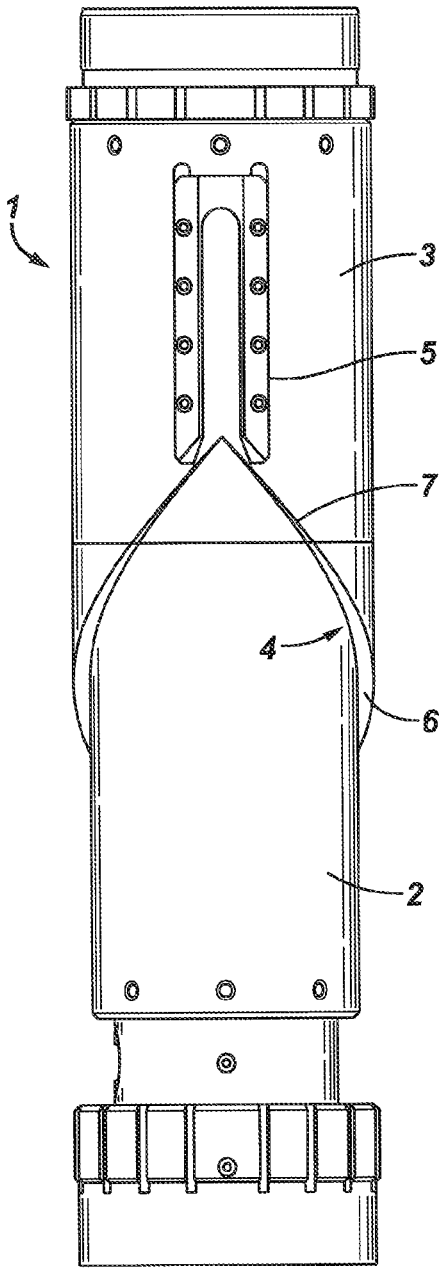
FIGS. 1*a* and 1*d* is a side comparison view of an embodiment of a telescoping hanger joint in retracted and extended positions.
Figure 1B:
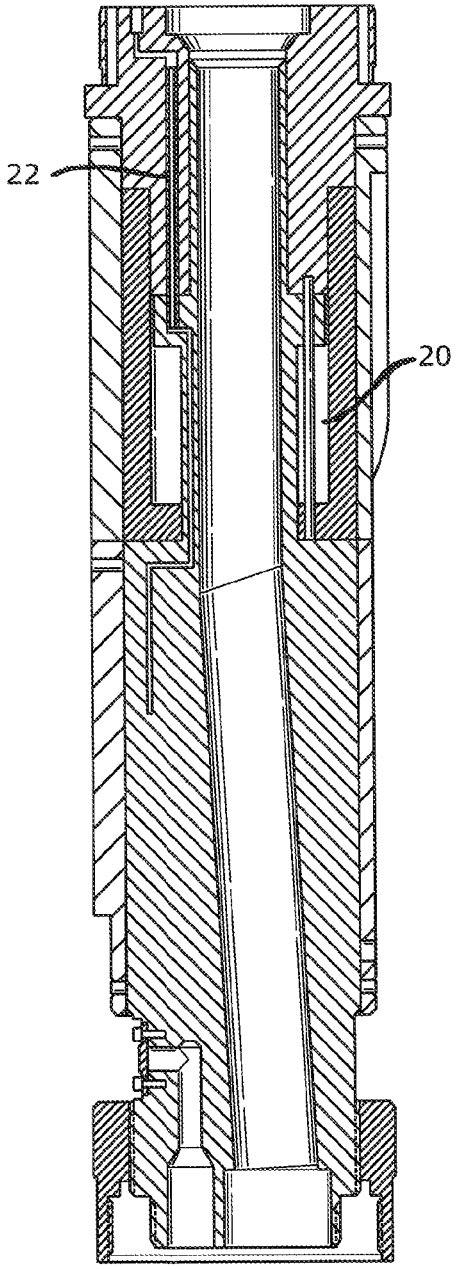
FIGS. 1*b* and 1*c* are sectional views of a side comparison of an embodiment of a telescoping hanger joint in a retracted and extended position.

The present application design proposes a telescoping THOJ, which provides an orientation helix for orienting the landing string, but which subsequent to landing may be split and telescoped to provide a sealing (or shearing) surface across the desired BOP rams, as may be required for subsequent operations. In FIGS. 1*a*-1*d*, the THOJ 1 can be seen in its retracted and extended positions. In the retracted position, the orientation helix 4 is continuous (or substantially continuous in the sense that a pin or other protuberance will be guided along the helix without). This helix 4 engages a pin 12 protruding into the interior of the BOP 10 (pin shown in FIGS. 2*a* and 2*b*) to rotate the landing string to the correct orientation as the landing string is lowered, until the correct orientation is reached and the BOP 10 pin 12 reaches the vertical slot 5. The landing string is then fully landed out with the correct orientation. In the extended position, the helix 4 is split to expose a ported slick joint 8 against which the BOP pipe ram 11 can seal. The ported slick joint 8 can have a uniform outer diameter surface adapted for sealing with the BOP pipe ram 11. The BOP 10 space-out is shown in FIG. 2*b*.

Looking more specifically at FIGS. 1*a*-1*d*, a THOJ 1 is shown having a lower THOJ 2 and an upper THOJ 3. When in the retracted position, the helix 4 of the THOJ 1 forms a continuous helix stepped surface which leads to vertical slot 5. In practice, when lowered into a BOP 10 a pin 12 will contact the helix 4 and be forced along the helix 4 and into the vertical slot 5. This interaction between the helix 4, pin 12 and vertical slot 5 orients the THOJ 1 into a proper angular position.

The helix 4 can be a single stepped helix part or can be multiple helix parts. According to one embodiment, the helix 4 can be a first helix part and a second helix part where the first helix part and the second helix part converge toward one another as they are closer to the slot 5. In another embodiment the second helix part can mirror the first helix part. The helix parts can be concave in shape and face one another in the concave direction. According to yet another embodied feature, the step of the first helix part can face the step of the second helix part, thereby defining a low region between the helix parts to guide the pin 12 into the slot 5. The helix parts can converge and meet at an apex of the helix 4.

Figure 1C:
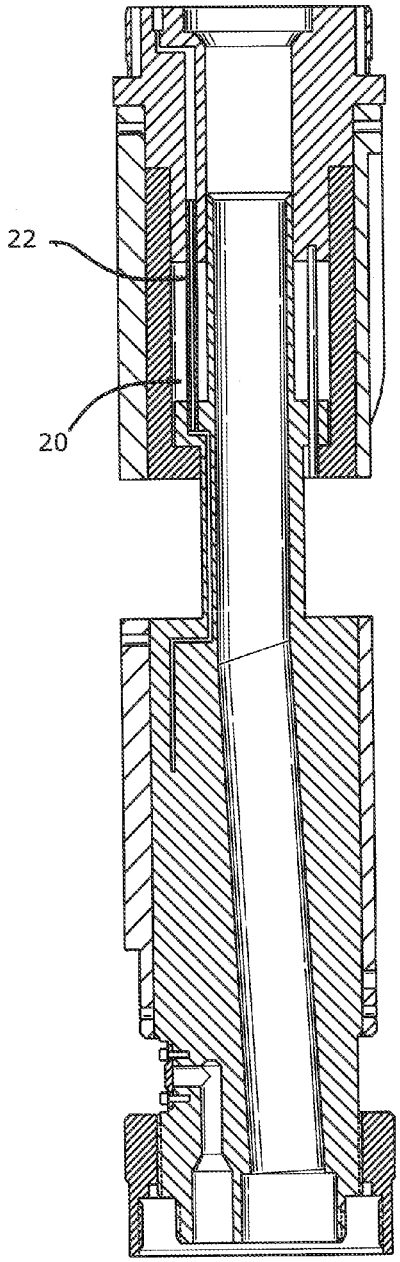
Figure 1D:
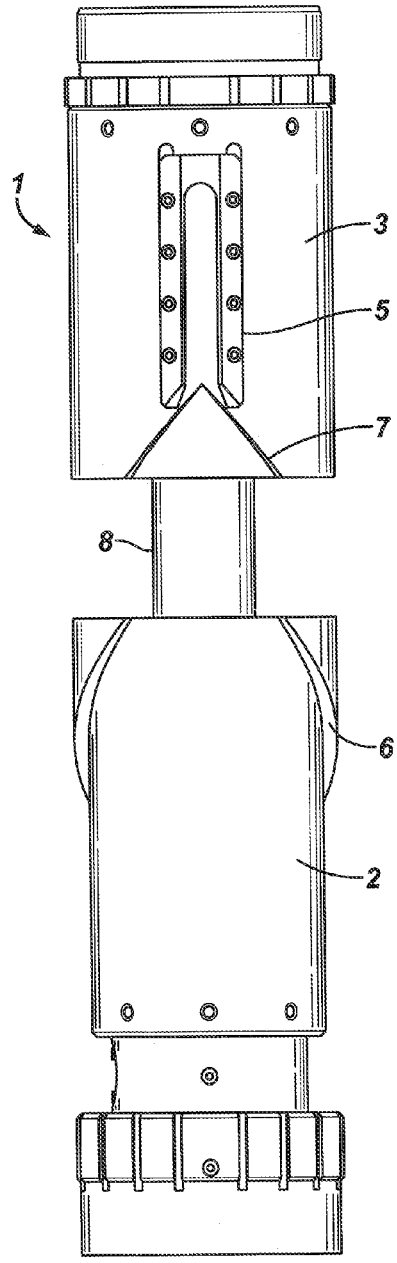

Once the THOJ 1 is oriented properly, the THOJ 1 is extended from the retracted position (FIGS. 1*a* and 1*b*) to the extended position (FIGS. 1*c* and 1*d*). When in the extended position, a ported slick joint 8 (seal surface) is exposed to the BOP pipe ram 11. Also, the helix 4 is divided into a lower helix 6 and an upper helix 7. The extension of the THOJ 1 can be accomplished by applying tensile force on the THOJ 1. Also, a hydraulic force (e.g., hydraulic chambers 20 in the THOJ) could be applied to extend the THOJ 1. FIG. 1*b* shows the hydraulic chamber 20 in a retracted state and FIG. 1*c* shows the hydraulic chamber 20 in the extended state with a hydraulic tube 22 extended as well.

Figure 2A:
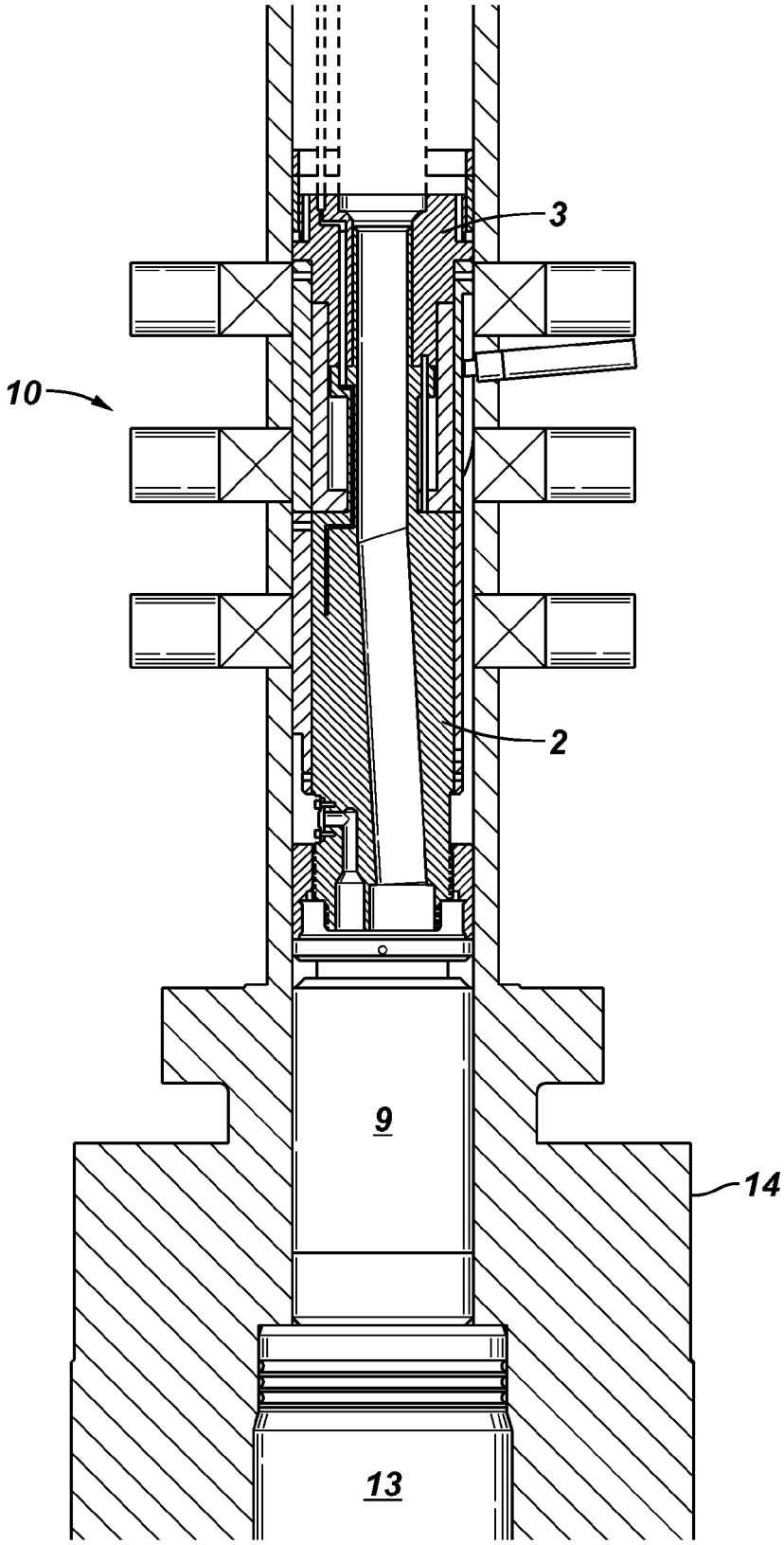
FIGS. 2*a* and 2*b* are side cross-sectional comparison views of an embodiment of the hanger joint in retracted and extended positions within a space-out location of blowout preventer equipment.
Figure 2B:
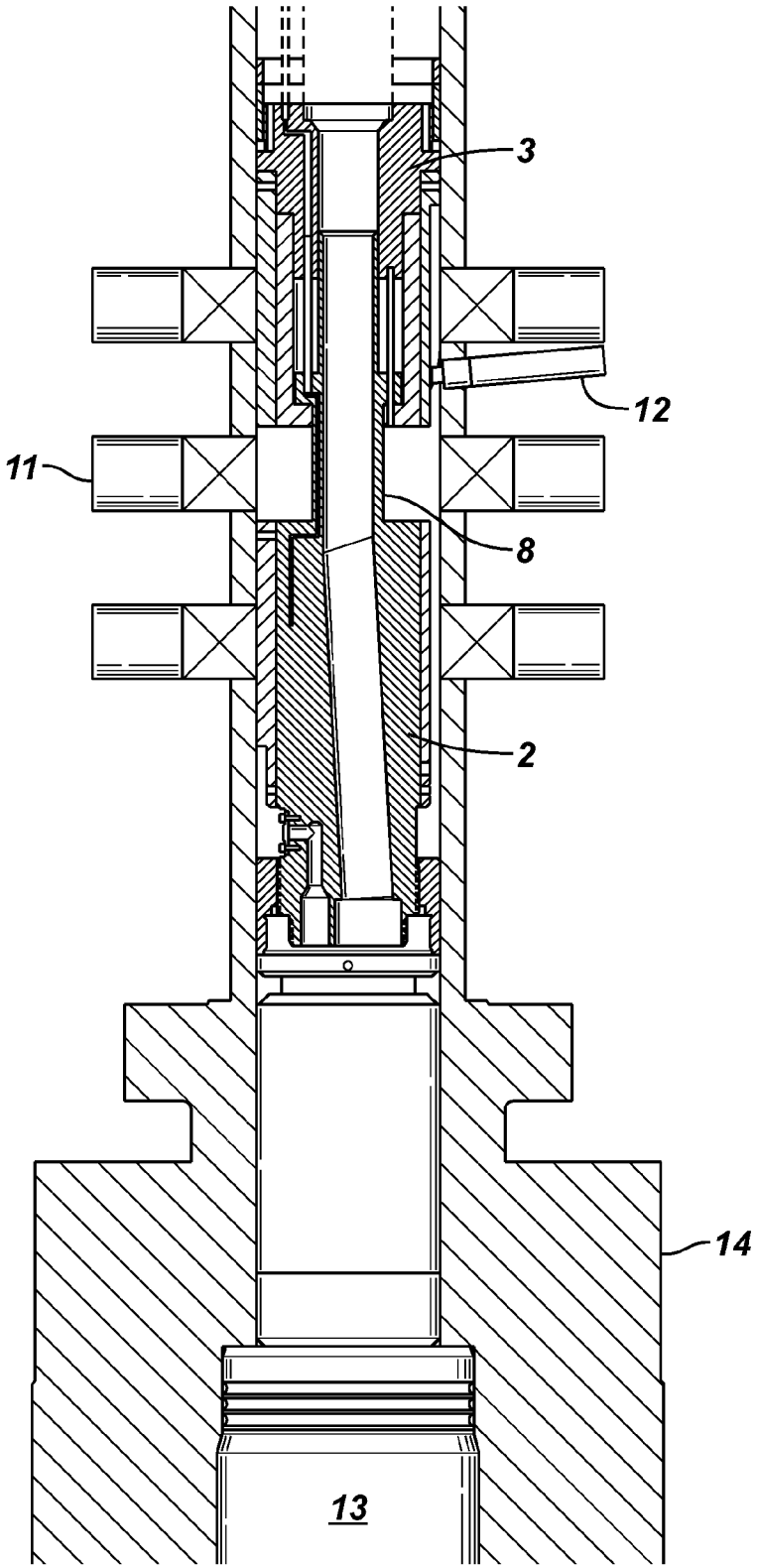

FIGS. 2*a* and 2*b* show a wellhead 13 in connection with the BOP 10. A BOP Wellhead Connector 14 and Tubing Hanger 9 are also schematically shown.

In this way, the proposed orientation joint provides both a continuous helix 4 for orienting the landing string, and a sealing surface 8 (e.g., ported slick joint) against which the BOP pipe rams 11 can close once the string is landed.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A method of deploying a subsea landing string, the subsea landing string having a helix that converges to a slot and interacts with a portion of a blowout preventer to orient the subsea landing string, comprising:

lowering the subsea landing string through a riser and into the blowout preventer while a joint of the subsea landing string is in a retracted position where the helix is continuous;

interacting the helix with a protrusion in the blowout preventer so that the subsea landing string is oriented, wherein upon fully lowering the joint the protrusion becomes located in the slot;

extending the joint while the subsea landing string is landed so that the joint has an upper helix portion and a lower helix portion that is separated by a sealing surface, the sealing surface being adjacent to a blowout preventer pipe ram, wherein the joint is extended by applying tension to the subsea landing string.

2. The method of claim 1, wherein the protrusion is a pin in the blowout preventer.

3. The method of claim 1, wherein the helix comprises a first helix and a second helix, the helixes together converging toward a point proximate the slot.

4. The method of claim 3, wherein the second helix portion mirrors the first helix portion.

5. The method of claim 1, wherein the joint is extended by applying hydraulic pressure to the subsea landing string.

6. A joint of a subsea landing string, comprising:

an upper portion and a lower portion, the upper portion being connected by way of a telescoping joint, the telescoping joint portion having a narrower cross sectional diameter than the upper portion and the lower portion;

the joint having a contracted position where upper portion and the lower portion and adjacent to one another and the telescoping joint portion is not exposed, and a landed extended position where the upper portion and the lower portion are separate from one another and the telescoping joint portion is exposed there between, wherein the extended position is achieved by way of application of tension to the upper portion; and a stepped helix is located on the external surface of the joint and leads to a slot so that when interacting with a protrusion of a blowout preventer during lowering the joint of the subsea landing string is oriented.

7. The joint of claim 6, wherein the helix comprises a first helix portion and a second helix portion, wherein the first and second helix portion converges toward one another and meets at a point proximate the slot.

8. The joint of claim 7, wherein the depth of the stepped helix portion varies along the length of the helix portion.

9. The joint of claim 8, wherein the depth of the helix is smaller the closer the helix is to the slot.

10. The joint of claim 7, wherein the second helix portion mirrors the first helix portion.

11. The joint of a subsea landing string of claim 6, wherein the first helix portion mirrors the second helix portion.

12. The joint of claim 6, wherein the extended position is achieved by way of application of hydraulic pressure to the joint.

* * * * *